United States Patent [19]

Voegeli

[11] Patent Number: 4,708,409

[45] Date of Patent: Nov. 24, 1987

[54] DISPLAY CONTAINER FOR PUBLICATIONS

[76] Inventor: Ronald C. Voegeli, 918 Gibbs Rd., Venice, Fla. 33595

[21] Appl. No.: 817,088

[22] Filed: Jan. 8, 1986

[51] Int. Cl.[4] ..... A49F 3/00

[52] U.S. Cl. ..... 312/138 A; 312/319; D20/6

[58] Field of Search ..... 49/168, 169, 171, 386; 160/DIG. 8, 368 R, 354, 327; 312/138 R, 138 A, 114, 100, 319; D20/6

[56] References Cited

U.S. PATENT DOCUMENTS

| | | | |
|---|---|---|---|
| D. 242,381 | 11/1976 | Burck | D20/6 |
| 2,282,990 | 5/1942 | De Paul | 49/386 |
| 2,783,833 | 3/1957 | Cann | 160/DIG. 8 |
| 3,174,608 | 3/1965 | Knickerbocker | D20/6 |
| 4,047,331 | 9/1977 | Davlantes | 49/171 |

*Primary Examiner*—Joseph Falk

*Attorney, Agent, or Firm*—Burns, Doane, Swecker & Mathis

[57] ABSTRACT

A display container for publications comprises a housing, a door swingably mounted to the housing, and a spring for biasing the door closed. The door comprises a sheet of transparent flexible material anchored along an inner edge thereof to the housing so as to be flexibly swingable in cantilever fashion. The spring comprises a coil spring having outer and inner ends connected to an interiorly facing surface of the door so that movement of the door to an open condition elastically deforms the spring to bias the door closed. The spring bears against the door to be capable of holding a display publication which is inserted between the spring and the door.

13 Claims, 6 Drawing Figures

Fig. 2
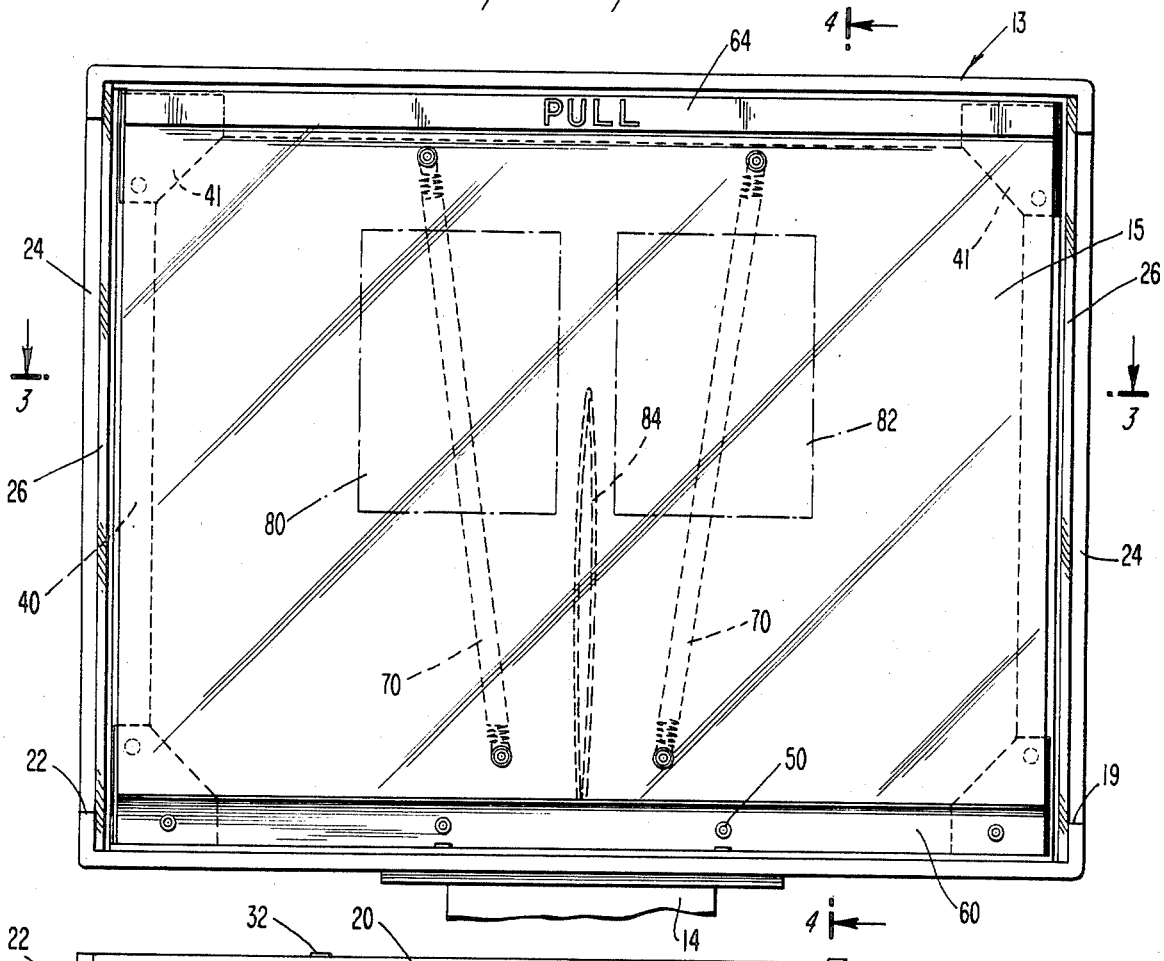
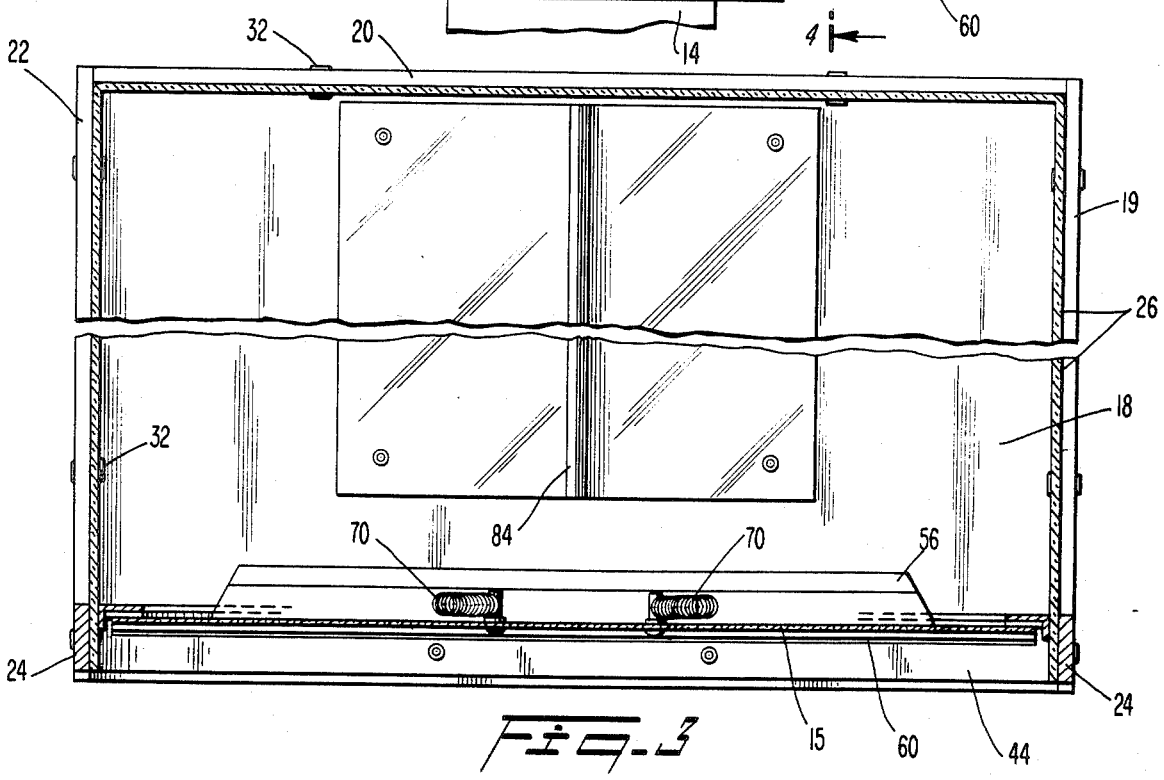
Fig. 3

DISPLAY CONTAINER FOR PUBLICATIONS

BACKGROUND AND OBJECTS OF THE INVENTION

The present invention relates to display containers or racks for publications and in particular to a display container of the freely accessible, non-coin operated type.

Display containers for publications can be of the coin-operated type as in the case of publications offered for sale or of the non-coin operated type as in the case of complementary publications made available at no charge, such as advertisement pamphlets for example. Since such complementary publications do not generate revenue, it would be desirable to provide display containers which are relatively inexpensive and maintenance free in order to minimize expenses. One manner of accomplishing such a result is to minimize the amount of materials employed in the fabrication of the container, and the number of moving parts which are susceptible to being worn out over a period of time. At the same time, however, it is desirable that the container perform certain functions such as protecting the publications from the environment, especially rain, and/or displaying the publication in such manner that passers-by will be able to easily notice and identify the publication.

It is, therefore, an object of the present invention to provide a display container which is relatively inexpensive and maintenance free.

Another object is to provide a display container which incorporates a minimum amount of moving parts.

Another object is to provide a display container which protects publications from the environment, and which displays publications in an easily noticeable manner.

SUMMARY OF THE INVENTION

These objects are achieved by the present invention which relates to a display container for publications. The container is of the type comprising a housing, a door swingably mounted to the housing, and a spring for biasing the door closed. The door comprises a sheet of transparent flexible material anchored along an inner edge thereof to the housing so as to be flexibly swingable in cantilever fashion to an open condition wherein the door forms a curvalinear flexure region interconnecting the anchored inner edge and an outer portion of the door when the door is in the open condition. The spring comprises an elastically deformable member having an outer end connected to an interiorly facing surface of the door outwardly of the flexure region and an inner end anchored inwardly of the flexure region so that movement of the door from a closed condition to an opened condition elastically deforms the expandable member to bias the door closed.

Preferably, the inner end of the spring is anchored to the interiorly facing surface of the door. Also, it is preferred that the spring bears against the door so as to be capable of holding a display publication which is inserted between the spring and the door.

BRIEF DESCRIPTION OF THE DRAWINGS

The objects and advantages of the invention will become apparent from the following detailed description of a preferred embodiment thereof in connection with the accompanying drawings in which like numerals designate like elements, and in which:

FIG. 2 is a front elevational view of the container, with display publications depicted in phantom lines;

FIG. 3 is a cross-sectional view taken along the line 3—3 in FIG. 2;

DETAILED DESCRIPTION OF A PREFERRED EMBODIMENT OF THE INVENTION

Figure 1:
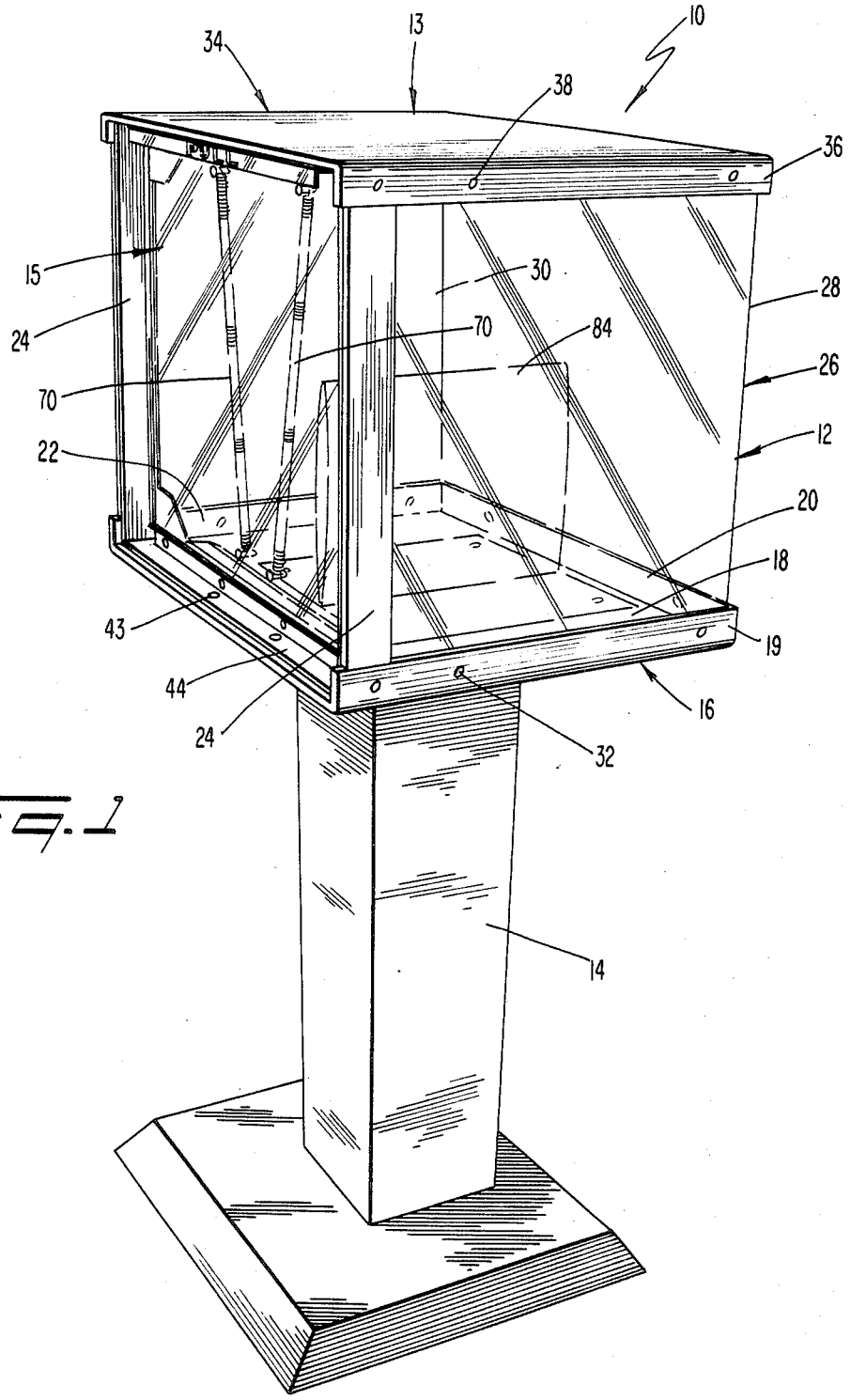
FIG. 1 is a perspective view of a display container according to the present invention, with the front door thereof in a closed condition.

A display container 10 according to the present invention comprises a container portion 12 carried atop a support pedestal 14. The container comprises a housing 13 to which a door 15 is swingably mounted. The housing includes a floor 16 which is directly attached to the pedestal. The floor can be formed of any suitably durable material such as metal, plastic, etc. The floor includes a base 18 and three upstanding flanges 19, 20, 22 extending along the sides and rear of the container.

Attached to front ends of the side flanges 19, 22 are a pair of posts 24 formed of a rigid material such as extruded aluminum for example. Extending around the sides and rear of the container is a transparent wall member 26 formed of a transparent flexible material which is folded along vertical edges 28, 30 at the rear corners of the container so as to be in the form of a U-shaped (three-sided) wall. That wall 26 is secured to the flanges 19, 20, 22 and to the posts 24, e.g., by rivets 32, and forms the upstanding sides and rear of the container. One suitable material of which the wall 26 could be formed is a polycarbonate marketed under the tradename LEXAN ®.

Affixed to the upper ends of the posts 24 and the wall 26 is a cover 34 which includes downwardly depending flanges 36 extending around the sides and rear of the container. Those flanges are connected to upper edges of the posts 24 and wall 26 by rivets 38.

Figures 4, 5, 6:
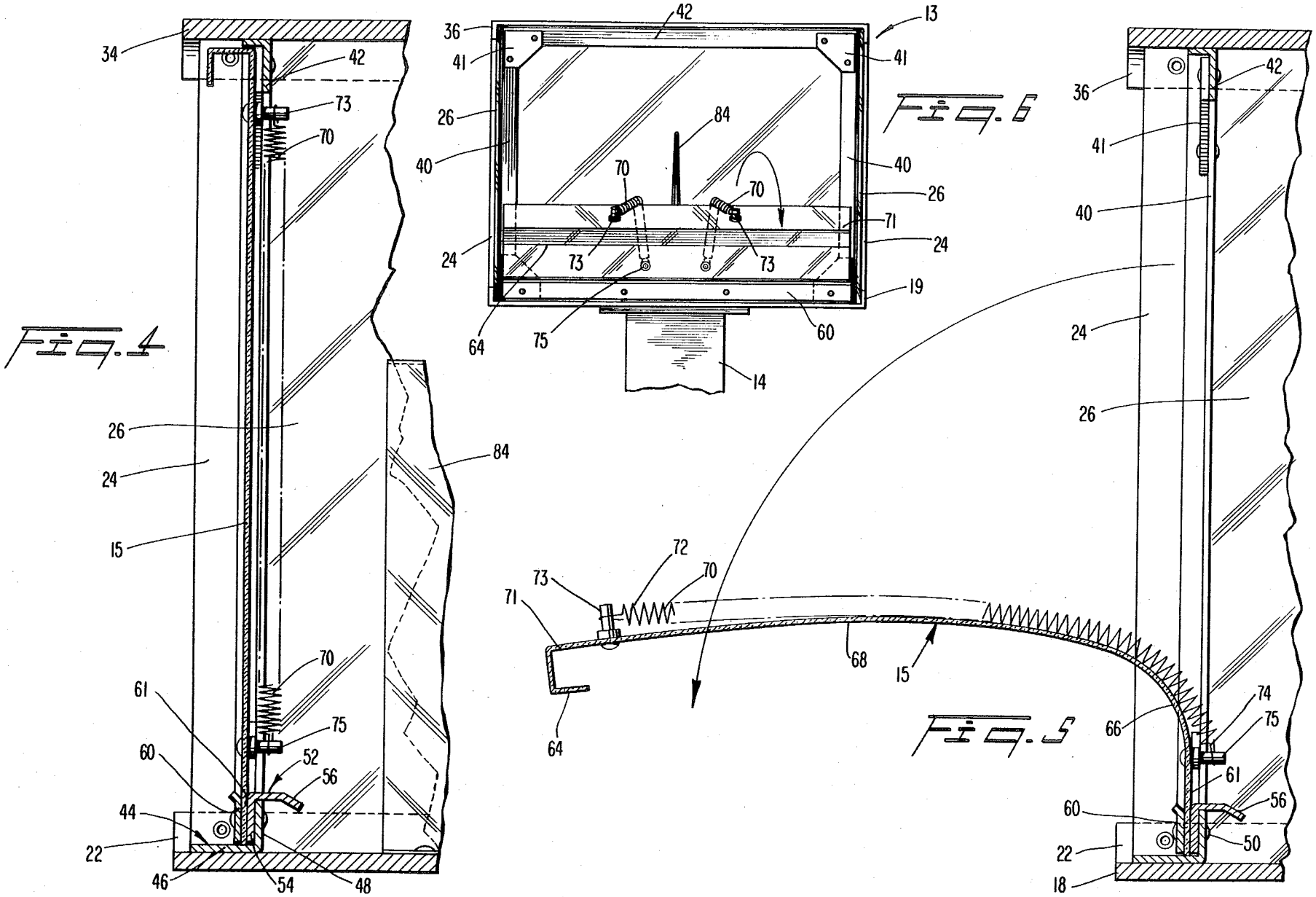
FIG. 4 is a vertical sectional view taken along the line 4—4 in FIG. 2.
FIG. 5 is a view similar to FIG. 4, but showing the door of the display container in an opened condition, and with the spring fully expanded.
FIG. 6 is a view similar to FIG. 2 depicting the door in an opened condition.

The posts 24 each include an upright leg 40 extending from the floor to the cover along inside edges of the posts (FIG. 6). Affixed to upper ends of the legs 40 by means of brackets 41 is a top horizontal cross-piece 42 (FIG. 6). Affixed to the floor 16 by rivets 43 is a lower horizontal cross-piece 44. The cross-piece 44 includes a bottom leg 46 (FIG. 4) which is anchored to the floor 16, and an upright leg 48 which is coplanar with the cross-piece 42 and the legs 40 of the posts 24.

Mounted to the upright leg 48 by rivets 50 is an insert plate 52. The insert plate 52 includes an upright leg 54 and a horizontal leg 56 which extends across the leg 48 of the lower cross-piece 44 and then downwardly so as to cover the upper edge of the leg 48.

The door 15 is attached to the lower cross-piece 44 for swinging movement to an open position (see FIG. 5). The lower edge 61 of the door is sandwiched between the lower cross-piece and a cover plate 60, with the rivets 50 extending through the cover plate 60, the door 15 and the leg 48 of the cross-piece 44. The door is formed of a transparent flexible material, preferably a polycarbonate such as LEXAN®. The upper or free edge of the door 15 is bent twice to form an integral gripping handle 64. By grasping and pulling the gripping handle 64, the door can be flexedly deformed downwardly in cantilever fashion about the inner anchored edge of the door as depicted in FIG. 5. In the open position of the door, the anchored inner edge 61 of the door remains essentially flat, and a curvalinear transition or flexure region 66 interconnects the inner edge 61 with a substantially flat outer portion 68 of the door.

In order to bias the door closed, a pair of springs 70 are provided. Each spring 70 comprises an elastically deformable member, preferably an elastically expandable member such as a coil spring as shown, or alternatively an elastic band. An outer end 72 of each spring 70 is secured to a post 73 on an interiorly facing surface 71 of the door 15 at a location outwardly of (i.e., above) the flexure region 66, and an inner end 74 of each spring 70 is secured to a post 75 on the door 15 at a location inwardly (i.e., below) the flexure region 66. As a result, when the door is opened, the springs become expanded, thereby biasing the door back to a non-deformed (closed) condition. Alternatively, the inner ends of the spring could be attached to the housing 13 rather than to the door, although the latter is preferred.

The springs 70 are arranged to bear against the surface 71 to be able to retain a viewable copy of the publication by sliding that copy between the springs and the door. Although only a single spring 70 could be employed if desired, it is preferable to employ two springs and to diverge them in the outward (upward) direction. By diverging the springs, the springs may selectively retain one or two publication copies. Thus, if two different publications are to be contained in the container, a copy of each such publication can be retained by a respective spring 70. Such copies 80, 82 (FIG. 2) would be positioned near the outer (farthest spaced) ends of the springs where there exists sufficient room to position both copies side-by-side. A suitable divider wall 84 could be positioned within the housing midway between the springs to separate the stacks of both copies within the housing.

If only a single copy of a publication is to be positioned for viewing, it can be positioned anywhere along the springs at a location where both springs would suitably engage the copy.

It will be appreciated that a container according to the present invention contains few moving parts, such as hinges, which could wear as a result of rubbing or friction. Furthermore, the container is relatively inexpensive since no hinges are involved. The springs remain protected from the environment and thus are less likely to rust. In addition, the springs are multi-functional in that they bias the door closed as well as holding one or more viewable copies of the publication.

Although the present invention has been described in connection with a preferred embodiment thereof, it will be appreciated by those skilled in the art that additions, modifications, substitutions, and deletions not specifically described may be made without departing fromthe spirit and scope of the invention as defined in the appended claims.

What is claimed is:

1. In a display container for publications of the type comprising a rigid stationary housing, a door swingably mount to said housing, and spring means for biasing said door closed, the improvement wherein:

said door is transparent to enable an interior of said container to be viewed through said door when said door is in a closed position, said door comprising a sheet of transparent flexible material achored along an inner edge thereof to said housing so as to be flexibly swingable in cantilever fashion to an open condition wherein said door forms a curvalinear flexure region interconnecting said anchored inner edge and an outer portion of said door when said door is in said open condition, said sheet including an inwardly facing rear surface and an exteriorly facing front surface, said spring means disposed behind said door and comprising an elastically deformable member having an outer end connected to said interiorly facing rear surface of said sheet outwardly of said flexure region and an inner end anchored inwardly of said flexure region so that movement of said sheet from a closed condition to an open condition elastically deforms said expandable member to bias said sheet closed, said deformable member biased toward said rear surface to retain a viewable copy of a publication slid into a position between said rear surface and said deformable member.

2. A display container according to claim 1, wherein said elastically deformable member comprises an elastically expandable member.

3. A display container according to claim 2, wherein said expandable member comprises a coil spring.

4. A display container according to claim 1, wherein said other end of said deformable member is anchored directly to said sheet.

5. A display container according to claim 4, wherein said deformable member comprises an elastically expandable member.

6. A display container according to claim 1, wherein there are two said deformable members which diverge in an outward direction, and a divider wall positioned inside said housing to divide the interior of said housing into separate spaces.

7. A display container according to claim 1, wherein said housing includes a floor, a plurality of upstanding transparent walls, and a top cover.

8. A display container according to claim 1, wherein said inner edge of said sheet comprises a lower edge thereof.

9. A display container for publications comprising:

a rigid stationary housing including a floor, a plurality of upstanding walls forming sides and a rear of said housing, and a top cover connected to said walls, a transparent door swingably mounted at a front of said housing and comprising an elastically flexible transparent material anchored to said housing along one edge thereof so as to be flexibly swingable in cantilever fashion to an open condition, said sheet including an inwardly facing rear surface and an exteriorly facing front surface, spring means disposed behind said door for biasing said door closed, comprising an elastically expandable member having inner and outer ends each connected to said interiorly facing rear surface of said sheet, said inner end situated adjacent said inner edge of said sheet and said outer end situated adjacent an outer edge of said sheet disposed opposite said inner edge, whereby said elastically expandable member is elastically tensioned in response to opening of said door, said deformable member biased toward said rear surface to retain a viewable copy of a publication slid into a position between said rear surface and said deformable member.

10. A display container according to claim 9, wherein said elastically expandable member comprises a coil spring.

11. A display container according to claim 9, wherein there are two said expandable members diverging in an outward direction, and a divider wall positioned inside said housing between said expandable members.

12. A display container according to claim 9, wherein said inner edge of said door comprises a lower edge thereof.

13. A display container according to claim 9, wherein there are two said expandable members, each adapted to retain a separate publication.

* * * * *